US006758024B1

(12) United States Patent
Mieger et al.

(10) Patent No.: US 6,758,024 B1
(45) Date of Patent: Jul. 6, 2004

(54) INDUSTRIAL SHAFT, PARTICULARLY FOR PACKAGING EQUIPMENT

(75) Inventors: Rolf Mieger, Unteropfingen (DE); Dirk Asam, Ulm (DE)

(73) Assignee: Liebherr-Hydraulikbagger GmbH, Kirchdorf an der Iller (DE)

( * ) Notice: Subject to any disclaimer, the term of this patent is extended or adjusted under 35 U.S.C. 154(b) by 0 days.

(21) Appl. No.: 09/718,607

(22) Filed: Nov. 22, 2000

(30) Foreign Application Priority Data

Nov. 24, 1999 (DE) ..... 299 20 652 U
Dec. 6, 1999 (DE) ..... 199 58 696

(51) Int. Cl.[7] ..... B66C 23/64
(52) U.S. Cl. ..... 52/732.1
(58) Field of Search ..... 52/220.7, 730.4, 52/732.1, 731.4, 731.6, 731.8, 732.3, 737.6; 212/347, 348, 349, 350

(56) References Cited

U.S. PATENT DOCUMENTS

| | | | | |
|---|---|---|---|---|
| 3,243,052 A | * | 3/1966 | Grove | 212/349 |
| 4,193,734 A | | 3/1980 | Williams | |
| 4,506,480 A | * | 3/1985 | Murrill et al. | 52/121 |
| 4,809,472 A | * | 3/1989 | Hade et al. | 52/118 |
| 5,806,313 A | | 9/1998 | Koshi et al. | |
| 6,530,742 B2 | * | 3/2003 | Trinler et al. | 212/348 |

* cited by examiner

*Primary Examiner*—Michael Safavi
(74) *Attorney, Agent, or Firm*—Dilworth & Barrese, LLP.

(57) ABSTRACT

An industrial shaft, particularly for packing equipment, consisting of a longitudinal frame structure and supply lines for pressure, current, or the like, running along the frame structure. The frame structure has a box-shaped cross-section, and the supply lines run inside the box-shaped frame.

13 Claims, 4 Drawing Sheets

INDUSTRIAL SHAFT, PARTICULARLY FOR PACKAGING EQUIPMENT

BACKGROUND OF THE INVENTION

The invention concerns an industrial shaft having a longitudinal frame structure and supply lines for pressure, current, or the like, running along the frame structure; as it can be used in particular for wrapping equipment.

State of the art industrial shafts are illustrated in FIGS. 1 and 2. The embodiment illustrated here is a bagger shaft. The bagger shaft 10 consists of a longitudinal frame structure made of metal sheets welded together and supply lines 12 running along the frame structure, which in this embodiment serve to convey hydraulic fluid. The hydraulic fluid is needed to drive bagger tools directly or indirectly connected to the bagger shaft. The supply lines 12 are guided according to the state of the art along the outside of the frame structure, as illustrated in FIG. 2. In FIG. 1 the supply lines 12 are exploded individually. The broken lines of course indicate how the supply lines are attached to the frame structure. The carrier trestles 14 welded to the outside of the frame structure are shown individually in FIG. 1, with the supply lines 12 attached to the carrier trestles 14 by means of clamps 16. The front ends of the supply lines 12, that is, the ends facing the tool, are attached via adapters 18 on the frame structure of the industrial shaft 10 to a perpendicular metal sheet 20.

Because the supply lines are attached on the outside of the industrial shaft, they are exposed to the danger of damage. Their mounting is comparatively expensive, and because of the hose clamps that must be provided as connectors, the number and size of the supply lines is fixed and cannot be changed.

SUMMARY OF THE INVENTION

The object of the invention is to perfect an industrial shaft of the aforementioned type in such manner that the supply lines are guided along the longitudinal shaft in a simple manner.

Starting with a generic industrial shaft, the object is performed by way of the typical characteristics of the frame structure having a box-shaped cross-section and the supply lines running within the box-shaped cross section; according to which the frame structure of the industrial shaft has a box-shaped cross-section and the supply lines are positioned inside the box-like structure.

This solution ensures a high degree of rigidity for the industrial shaft because of its box-shaped cross section. The supply lines running inside the box-like frame structure are protected from damage in a particularly advantageous manner. Also, fewer attachment devices are needed for the supply lines than is customary in the state of the art. Because the attachment devices do not have to be welded to the outside of the shaft, the grooves caused by the attachment devices are eliminated. The solution according to the invention also makes it possible to add additional supply lines without further problems, since no clamps with a predetermined number of hoses or hose sizes have to be used.

Not only are the connection lines protected from mechanical damage, but temperature fluctuations in the housing, such as freezing or heat, are diminished, and changes in materials because of the influence of ultraviolet rays are prevented.

The clamps for attaching supply lines can no longer become loose during operation, since attachment devices such as clamps in the center area along the industrial shaft are eliminated, and loosening effects previously caused by heat expansion and deformation of the housing, and loss of tension in the attachment devices, are eliminated.

Mounting the line becomes much easier because of the elimination of the clamps.

Advantages of the invention are produced as described herein.

Accordingly, within the frame structure with box-shaped cross-section a holder extending at least partly along the length of the frame is created to hold the supply line. The frame structure and the holder can be constructed as weldments. Advantageously, the frame structure has a rectangular cross-section.

BRIEF DESCRIPTION OF THE DRAWINGS

Additional details and advantages of the invention are produced in the embodiments of the invention illustrated in the attached drawings, showing.

DESCRIPTION OF THE PREFERRED EMBODIMENTS

Figure 1:
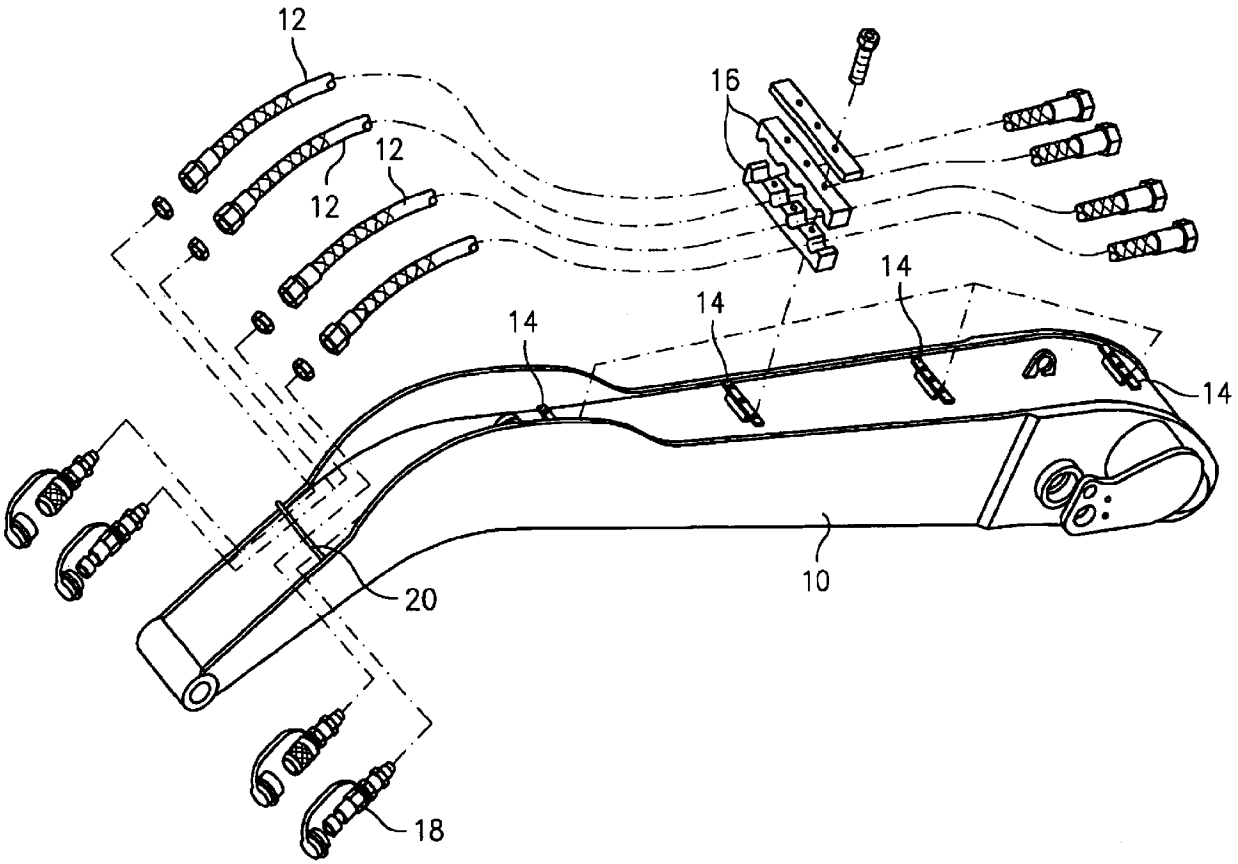
FIG. 1 (PRIOR ART)
FIG. 1 A partially exploded drawn-out perspective view of an industrial shaft according to one embodiment in the state of the art.
Figure 2A:
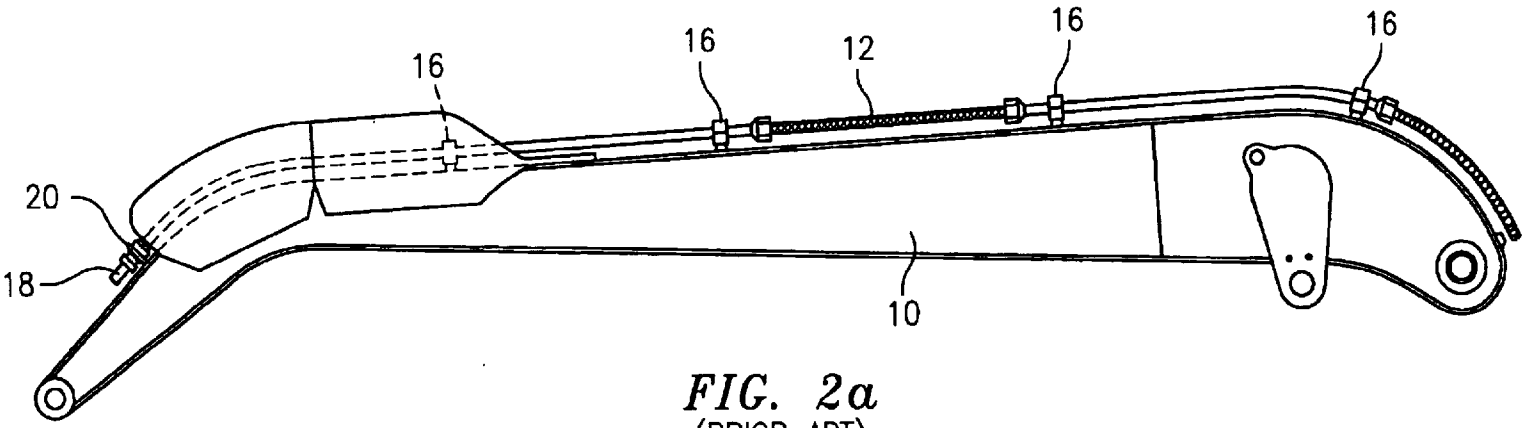
FIG. 2a (PRIOR ART)
FIG. 2*a* is a side view of the industrial shaft in the state of the art according to FIG. 1.
Figure 2B:
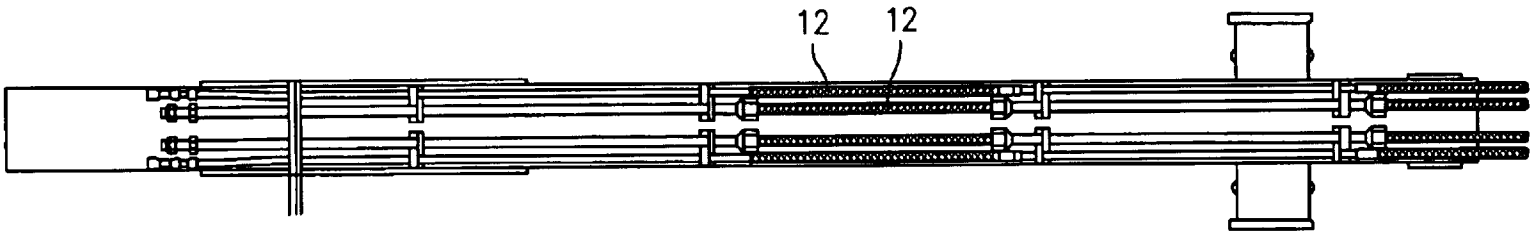
FIG. 2b (PRIOR ART)
FIG. 2*b* is a top view of the industrial shaft in the state of the art according to FIG. 1.
Figure 3A:
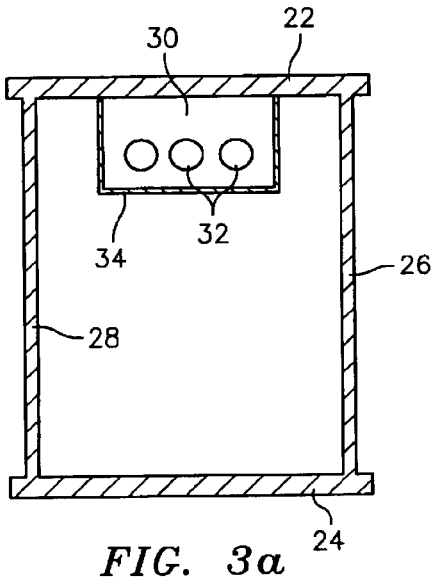
FIGS. 3*a*–3*d* show four different cross sections through four different variant embodiments of the industrial shaft according to the invention.
Figure 3B:
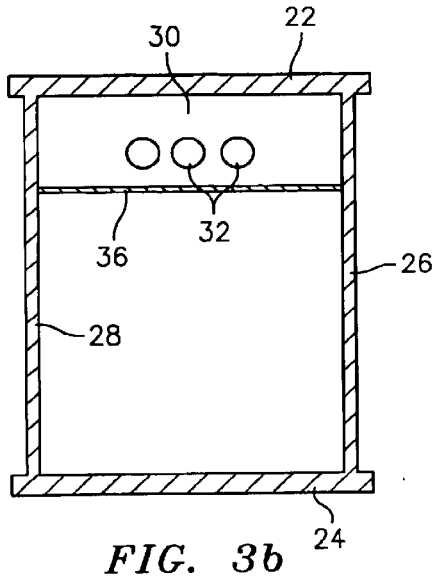
Figure 3C:
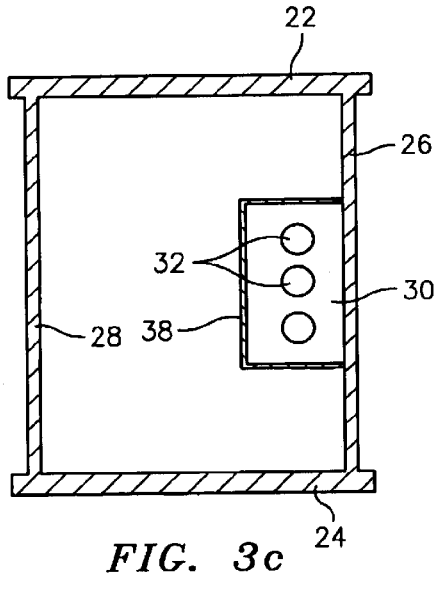
Figure 3D:
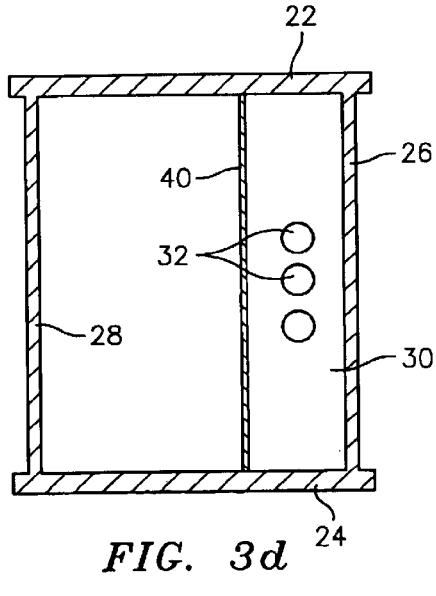
Figure 4:
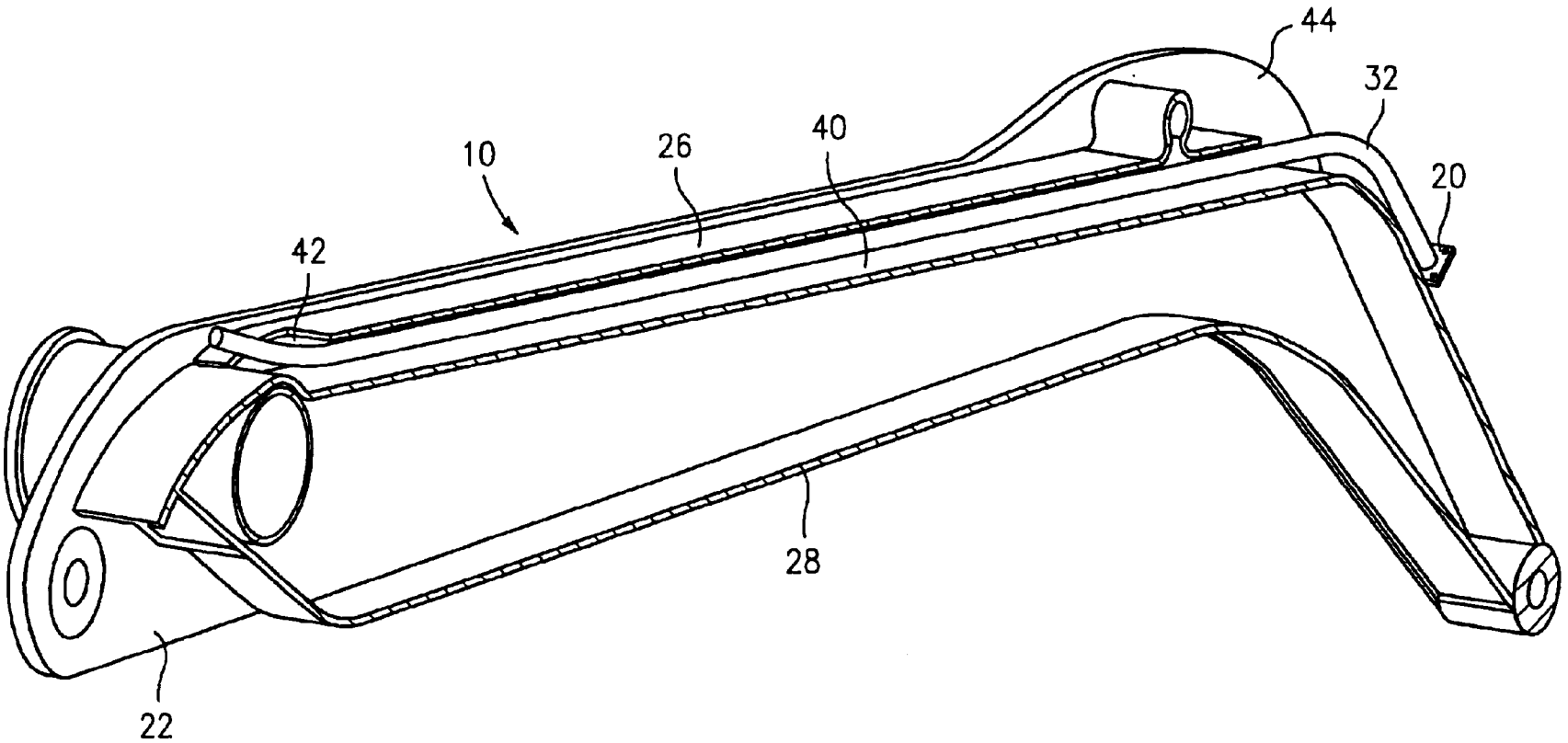
FIG. 4 A partially cut perspective illustration of an industrial shaft in one embodiment of the within

FIG. 4 illustrates an industrial shaft 10 that consists of a long frame structure. The embodiment illustrated here shows a bagger shaft that is bent downward at its end facing the tool, not illustrated here in detail. The frame structure is shown schematically in cross-section in FIGS. 3*a, b, c*, and *d*. Two side metal sheets 22 and 24, a top metal sheet 26, and a bottom metal sheet 28 are provided. The resulting overall cross-section is rectangular. The four variant embodiments illustrated in FIG. 3 differ in their respective positioning of the holder 30 provided for the supply lines 32. In FIG. 3*a*, holder 30 is formed by a box-shaped weldment 34 that is welded to side wall 22. In the embodiment of FIG. 3*b*, the holder 30 is formed by a metal sheet wall 36 that runs the entire height of the cross-section and which is parallel to side wall 22. In the embodiment in FIG. 3*c*, a box structure 38 is welded to metal sheet 26 to form the holder 30, and in the embodiment according to FIG. 3*d*, a metal sheet 40 bounding the holder 30 parallel to wall 26 is welded inside the cross-section of the frame structure to side walls 22 and 24.

Variant 3*d* is illustrated in greater detail in the embodiment according to FIG. 4. Wall 26 has openings 42 and 44 for inserting supply lines 32 into, and removing them from, the holder 30 through the appropriate shaft ends. The ends of the supply lines, which in the embodiment are hydraulic lines for the bagger shaft, are attached to a perpendicular metal sheet 20 on the outside of the frame structure.

Adapters can be inserted here in known manner to connect the hydraulics lines with the supply lines of the bagger tool, not illustrated here in detail.

The installation of the lines in the embodiment described here in detail is explained by means of a bagger shaft, that is, an industrial shaft for a packaging device. Theoretically, however, the invention can also be used with a swivel arm, a boom, or a monoblock.

What is claimed is:

1. An industrial shaft having a longitudinal frame structure comprising, when oriented to the ground, a top metal sheet, a bottom metal sheet, and two side metal sheets together defining a box-shaped section, and a box-shaped weldment along which supply lines for pressure, current, or the like, run, wherein said box-shaped weldment is welded to an interior side of said top metal sheet of said metal sheets forming said longitudinal frame structure, said shaft being a bagger shaft structured and arranged to be coupled to packaging equipment, said shaft having a front end bent downwardly at an angle from the rest of the shaft, said box-shaped weldment being spaced rearwardly from said bent front end and within said shaft, and comprising a substantially perpendicular metal sheet mounted upon said bent front end of said shaft and arranged to support the lines exiting from within said shaft and weldment upon an outside of the frame structure.

2. The shaft of claim 1, wherein the bottom sheet of said box-shaped weldment is structured and arranged to support the lines running along an interior surface thereof opposite said top metal sheet of said longitudinal frame structure.

3. The shaft of claim 1, wherein said box-shaped weldment extends along substantially the entire length of said longitudinal frame structure.

4. The shaft of claim 2, wherein said box-shaped weldment extends along substantially the entire length of said longitudinal frame structure.

5. The shaft of claim 1, wherein said box-shaped weldment is structured and arranged to support the lines in the absence of clamps.

6. The shaft of claims 2, wherein said box-shaped weldment is structured and arranged to support the lines in the absence of clamps.

7. The shaft of claim 3, wherein said box-shaped weldment is structured and arranged to support the lines in the absence of clamps.

8. The shaft of claim 1, wherein both said outer longitudinal frame structure and said inner box-shaped weldment each comprise a substantially rectangular cross-section.

9. The shaft of claim 2, wherein both said outer longitudinal frame structure and said inner box-shaped weldment each comprise a substantially rectangular cross-section.

10. The shaft of claim 3, wherein both said outer longitudinal frame structure and said inner box-shaped weldment each comprise a substantially rectangular cross-section.

11. The shaft of claim 1, wherein said top sheet comprises openings for insertion of the supply lines into the shaft and weldment, with one of said openings being adjacent said bent front end and the other opening at an end of the longitudinal frame structure opposite said first opening, and with said weldment extending within said longitudinal frame structure between said two openings.

12. The shaft of claim 11, wherein said front end is bent in a direction toward said weldment and away from said top sheet.

13. The shaft of claim 1, wherein said front end is bent in a direction toward said weldment and away from said top sheet.

* * * * *